United States Patent [19]

Budzich

[11] Patent Number: 4,793,238

[45] Date of Patent: Dec. 27, 1988

[54] CONTROL SIGNAL BLOCKING DIRECTION CONTROL VALVE IN LOAD-SENSING CIRCUIT

[75] Inventor: Tadeusz Budzich, Moreland Hills, Ohio

[73] Assignee: Caterpillar Inc., Peoria, Ill.

[21] Appl. No.: 68,494

[22] Filed: Jul. 1, 1987

[51] Int. Cl.[4] ..... F15B 13/02; F15B 13/08

[52] U.S. Cl. ..... 91/421; 91/446; 137/596.1; 137/596.13

[58] Field of Search ..... 91/421, 446, 444, 447, 91/462, DIG. 2; 60/460, 466; 137/596.13, 596.1

[56] References Cited

U.S. PATENT DOCUMENTS

| | | | |
|---|---|---|---|
| 3,415,166 | 12/1968 | Hinrilhs et al. | 91/421 |
| 3,847,180 | 11/1974 | Kroth et al. | 137/596.13 |
| 4,000,683 | 1/1977 | Schexnayder | 91/411 R |
| 4,154,261 | 5/1979 | Budzich | 137/596.13 |
| 4,222,409 | 9/1980 | Budzich | 91/446 X |
| 4,362,087 | 12/1982 | Budzich | 91/421 |
| 4,610,194 | 9/1986 | Budzich | 91/446 |
| 4,665,801 | 5/1987 | Budzich | 91/446 X |
| 4,679,492 | 7/1987 | Budzich | 91/446 X |
| 4,688,470 | 8/1987 | Budzich | 91/446 X |
| 4,694,731 | 9/1987 | Budzich | 91/421 |
| 4,741,248 | 5/1988 | Budzich | 91/421 |
| 4,747,335 | 5/1988 | Budzich | 91/436 X |

*Primary Examiner*—Edward K. Look
*Assistant Examiner*—George Kapsalas
*Attorney, Agent, or Firm*—J. W. Burrows

[57] ABSTRACT

A load sensing circuit of a load responsive direction control valve including a device for sensing load pressure signals, identifying those pressure signals as positive or negative and transmitting those identified positive or negative load pressure signals to the throttling compensator controls of the load responsive valve. The load pressure signal identifying circuit responds to the control pressure signals, which determine the desired direction of displacement of the spool of the direction control valve, while those control pressure signals are selectively isolated from the identifying circuit, in response to the direction of spool displacement from its neutral position.

10 Claims, 1 Drawing Sheet

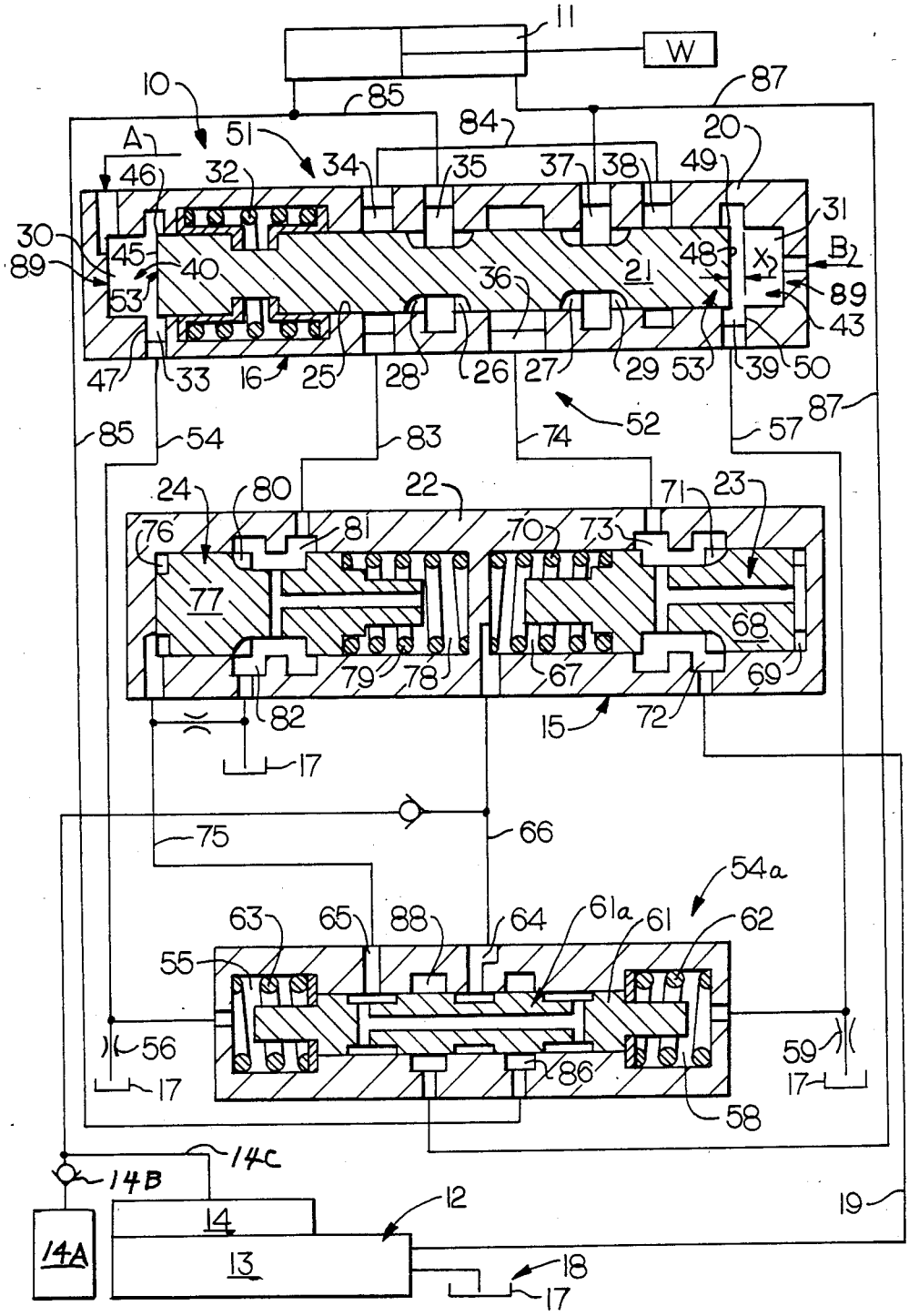
W
11
10
85
87
84
A
51
20
46
32
34
35
37
38
49
31
30
45
40
48
X
B
89
53
36
21
89
43
47
33
16
25
28
26
27
29
53
39
50
52
87
85
54
83
74
57
24
80
22
71
23
76
81
70
73
77
68
79
78
67
69
82
15
72
17
75
66
54a
63
65
88
64
61a
61
62
55
56
86
59
17
17
58
14c
14B
12
19
14
14A
13
18
17

CONTROL SIGNAL BLOCKING DIRECTION CONTROL VALVE IN LOAD-SENSING CIRCUIT

BACKGROUND OF THE INVENTION

1. Field of the Invention

This invention relates generally to the load sensing controls of a load responsive system.

In more particular aspects this invention relates to positive and negative load pressure identifying and transmitting controls, for use in load responsive systems.

In still more particular aspects this invention relates to positive and negative load pressure identifying and transmitting controls, which can respond with direction control spool in its neutral position, in anticipation of the system demand.

2. Description of the Prior Art

Load pressure sensing, identifying and transmitting circuits are widely used in control of load responsive systems. Such load pressure sensing, identifying and transmitting circuits usually employ check valve or shuttle valve logic systems, in identification of maximum system load pressure, while various types of load pressure sensing ports, sequentially interconnected by the direction control spool, are used in identification of whether the load pressure signal is positive or negative.

The presence of such load sensing ports, positioned in the bore of a direction control spool, inevitably increases the total spool stroke and dead band of the spool, making the control less sensitive. In order not to increase the dead band of the valve, the flow area of the load pressure sensing ports is selected as small as possible, resulting in substantial attenuation of the signal and greatly affecting the response of the compensating controls. Such load pressure sensing ports are shown in my U.S. Pat No. 4,154,261, issued May 15, 1979. Since such load pressure sensing ports are gradually uncovered, with the displacement of the direction control spool from its neutral position, at small displacements the attenuation of the load pressure signal is very great. This type of load pressure sensing circuit suffers from one additional disadvantage. Since the movement of the direction control spool is directly used in interconnecting the load pressure signal to the compensator or pump controls, it is impossible to transmit such signals with the direction control spool in its neutral position and in anticipation of the control function. Such a load sensing circuit, provided with the feature of anticipation, is shown in my U.S. Pat. No. 4,610,194, issued Sept. 9, 1986. This type of load sensing circuit, although very effective, suffers from one disadvantage in that the load pressure signal identifying shuttle might be adversely affected with very rapid change in the control pressure differential of the spool position control signals.

SUMMARY OF THE INVENTION

It is therefore a principal object of this invention to provide a load pressure sensing, identifying and transmitting circuit, capable of transmitting identified load pressure signals to the compensator and pump controls, in which transmission of the control signals to the load pressure identifying circuit is related to both the direction and specific displacement of the direction control spool from its neutral position.

It is a further object of this invention to provide a load pressure sensing, identifying and transmitting circuit, which responds to the control signal associated with the specific direction of displacement of the control spool, after the control spool is displaced a specific distance from its neutral position.

It is another object of this invention to provide a load pressure identifying circuit, which is insensitive to high transients in the control pressure differential, used in positioning of the direction control spool, while the direction control spool is displaced, through a specific distance from its neutral position.

It is another object of this invention to provide a load pressure identifying circuit, capable of transmitting identified load pressure signals to the compensator and pump controls, in anticipation of displacement of the direction control spool from its neutral position, in which the transmission of control signals to the load pressure identifying circuit is related to the direction of displacement of the control spool, after the control spool is displaced a specific distance from its neutral position.

It is another object of this invention to provide a load pressure signal identifying circuit, which permits great simplification in remote control signal generating controls, both of manual and servo types.

Briefly the foregoing and other additional objects and advantages of this invention are accomplished by providing a novel load pressure sensing, identifying and transmitting circuit, with minimum attenuation of the load pressure control signals, which selectively eliminates transmittal of control signals used in positioning of the direction control spool to the load pressure identifying circuit, in order to maintain full synchronization between the load pressure sensing and identifying circuit and the command controls signals, transmitted to the direction control spool.

Additional objects of this invention will become apparent when referring to the preferred embodiment of this invention as shown in the accompanying drawing and described in the following detailed description.

BRIEF DESCRIPTION OF THE DRAWING

The drawing is a longitudinal sectional view of an embodiment of a single stage compensated, direction control valve responding to hydraulic control signals through control and cut-off chambers, together with a sectional view of load pressure signal identifying and transmitting valve schematically shown system pump, pump controls, load actuator and system reservoir, all connected by schematically shown system fluid conducting lines.

DESCRIPTION OF THE PREFERRED EMBODIMENT

Referring now to the drawing, a load responsive, fully compensated, single stage valve assembly, generally designated as 10, is interposed between an actuator 11, operating a load W, and a source of pressure fluid 12, including a pump 13, provided with an output flow control 14, which may be of a bypass type, or of a variable displacement type, well known in the art, and which may respond, in a well known manner, to the maximum load signal pressure of the load responsive fluid power and control system of the drawing. A control signal from an additional load responsive valve assembly, schematically shown as 14A, is connected to the output flow control 14 through a check valve 14B and a conduit 14C. The single stage valve assembly 10 includes flow control means 15 of said load responsive system and first valve means 16. The pump 13 is connected to fluid exhaust means 18, which includes a system reservoir 17, and supplies, through discharge line 19 flow control means 15 with pressure fluid. The first valve means 16 is provided with a housing 20 having a direction control spool 21 slidably disposed therein, while flow control means 15 is provided with a housing 22 containing positive load compensating means 23 and negative load compensating means 24. The functional relationship between flow control means 15, including positive and negative load compensating means 23 and 24, which are of a single stage type, and which are used in control of both positive and negative loads, and first valve means 16, including the direction control spool 21, are similar to those described in detail in my U.S. Pat. No. 4,222,409, issued Sept. 16, 1980. Briefly, first valve means 16 comprises the direction control spool 21 slidably guided in bore 25 in the housing 20. The direction control spool 21 is provided with positive load metering slots 26 and 27 and negative load metering slots 28 and 29. One end of the direction control spool 21 projects into control space 30, subjected to pressure of a control signal A, while the other end projects into control space 31, subjected to pressure of a control signal B. In a well known manner, the direction control spool 21 is maintained in neutral position, as shown in the drawing, by a centering spring 32, well known in the art. Bore 25 intersects a first signal chamber 33, a first exhaust chamber 34, a first load chamber 35, a supply chamber 36, a second load chamber 37, a second exhaust chamber 38 and a second signal chamber 39. One end of the direction control spool 21 protrudes into control space 30 and is subjected to pressure of control signal A. The product of the pressure of control signal A and cross-sectional area of the end of the direction control spool 21 constitutes first force generating means 40. The other end of the direction control spool 21 protrudes into control space 31 and is subjected to pressure of control signal B. The product of the pressure of control signal B and cross-sectional area of the other end of the direction control spool 21 constitutes second force generating means 43. One end of the control spool 21 terminates in a cut-off surface 45, provided with cut-off edge 46, which cooperates with a timing surface 47, defining one end of the first signal chamber 33. The other end of the control spool 21 terminates in a cut-off surface 48, provided with cut-off edge 49, which cooperates with a timing surface 50, defining one end of the second signal chamber 39.

Positioning mean 51 of the direction control spool 21 include the first and second force generating means 40 and 43, opposing the force generated by the control spring 32, which in response to the magnitude of the pressures of control signals A and B determine the controlling position of the direction control spool 21.

Control signal blocking means 52 include first and second signal chambers 33 and 39, provided with timing surfaces 47 and 50, working in cooperation with cut-off edges 46 and 49 and include timing means 53 responsive to the position of the direction control spool 21, namely cut-off surfaces 45 and 48.

Load pressure identifying means **54*a* is operatively associated with the first valve means 16 and the flow control means 15. First signal chamber 33 of the first valve means 16 is connected by line 54 to a first control chamber 55 of the load pressure identifying means 54*a*, while line 54 is also connected through a leakage orifice 56 with the reservoir 17. In a similar manner a second signal chamber 39 of the first valve means 16 is connected by line 57 to a second control chamber 58 of the load pressure identifying means 54*a*, while line 57 is also connected through leakage orifice 59 with the reservoir 17. The first and second control chambers 55 and 58 are in direct communication with the ends of a logic shuttle 61, which is biased by springs 62 and 63 towards the position as shown on the drawing. Logic means 61*a* can be of any type operable to identify load pressure signals, for example a check valve logic, shuttle valve logic or electrical logic, which are all capable of identifying load pressure signals as positive or negative. Both the construction and operation of the load pressure identifying means 54*a* were described in great detail in my U.S. Pat. No. 4,610,194, issued Sept. 9, 1986. Briefly, depending on whether the load W is positive or negative, with respect to the intended correction in its position, full displacement of the logic shuttle 61 in either direction, either connects positive load pressure to port 64, or negative load pressure to port 65**.

Port 64, subjected to positive load pressure, is connected by line 66 with a control chamber 67 of the positive load compensating means 23. The positive load compensating means 23 is provided with a throttling spool 68 that is subjected at one end to pressure in a control chamber 69, while also being subjected at the other end to pressure in the control chamber 67 and the biasing force of a control spring 70. The throttling spool 68 by throttling action of throttling ports 71 controls the fluid flow from an inlet chamber 72 to an outlet chamber 73. The outlet chamber 73 is connected by line 74 with the supply chamber 36.

Port 65, subjected to negative load pressure, is connected by line 75 to a control chamber 76 of the negative load compensating means 24. A throttling spool 77, subjected to the pressure in a control chamber 78 and to the biasing force of a control spring 79, regulates fluid flow from an outlet chamber 81 to an exhaust chamber 82 by the throttling action of throttling ports 80. The exhaust chamber 82 is connected to the reservoir 17. The outlet chamber 81 is also connected by line 83 with first exhaust chamber 34, which in turn is connected by line 84 with the second exhaust chamber 38.

First load chamber 35 is connected by line 85 to the actuator 11 and to a chamber 86 of the load pressure identifying means **54*a* while the second load chamber 37 is connected by line 87 with the fluid motor 11 and a chamber 88 of the load pressure identifying means 54*a***.

Synchronizing mean 89 relates to the synchronizing action of the valve spool 21, provided with cut-off surfaces 45 and 48, with the action of the logic shuttle 61 in such a way that transmittal of the load pressure signals to the shuttle logic 61 is influenced by displacement of the valve spool 21 from its neutral position.

With the direction control spool 21 maintained in its neutral position, as shown, by the centering spring 32, in a manner well known in the art, first load chamber 35 and second load chamber 37 are completely isolated from the supply chamber 36 and first and second exhaust chambers 34 and 38. At the same time, as shown in the drawing, the connection from the first load chamber 35, through line 85 and the chamber 86, is blocked by the logic shuttle 61, while the connection from the second load chamber 37, through line 87 and the chamber 88, is also blocked by the logic shuttle 61. Under those conditions the fluid within the actuator 11, subjected to pressure generated by the load W, is completely isolated from the controlling elements of the control system.

Assume that the control pressure differential, developed between the pressure in control space 30, due to control signal A, and pressure in control space 31, due to control signal B, acting on the cross-sectional area of the end of the direction control spool 21, develops a force, just sufficient to balance the centering force of the centering spring 32, with control signal A being greater than control signal B.

Assume also that the centering force of the biasing springs 62 and 63, maintaining the logic shuttle 61 in neutral position, as shown in the drawing, is so selected, that with the pressure differential developed in first and second control chambers 55 and 58, necessary for full displacement of the logic shuttle 61 in either direction, is half of that required to displace the direction control spool 21 from its neutral position against the force of spring 32. Then, since control space 31 with the direction control spool 21 in its neutral position is directly connected with the second signal chamber 39, which in turn is connected through line 57 with the second control chamber 58 and since, in a similar manner, control space 30 is connected through first signal chamber 33 and line 54 to the first control chamber 55, the direction control spool 21 and the logic shuttle 61 will be subjected to the same pressure differential. Therefore, the logic shuttle 61 will be fully displaced through its entire stroke in either direction at control pressure differentials, well below those required to displace direction control spool 21 from its neutral position. Therefore, with control signal A assumed to be greater than control signal B, the logic shuttle 61 will be fully displaced to the right from its neutral position, before the direction control spool 21 is moved to the right from its neutral position. This control pressure transmitting circuit will remain the same until the direction control spool 21 is displaced to the right, through a distance X, in which position cut-off edge 49 will engage timing surface 50, effectively isolating the control signal B from the second control chamber 58, while the first control chamber 55 remains subjected to pressure, equivalent to control signal A. During further displacement to the right of the valve spool 21, under forces developed by the pressure differential due to the A and B control signals, the logic shuttle 61 will be subjected to the pressure, equivalent to control signal A, while second control chamber 58, through the action of leakage orifice 59, will be subjected to the pressure of the exhaust circuit of the reservoir 17.

With the valve spool 21 in its neutral position the logic shuttle 61 is subjected to the same pressure differential as the direction control spool 21 and the logic shuttle 61 is fully displaced through its entire stroke in the same direction as the intended direction of displacement of the direction control spool 21. This condition is maintained while the direction control spool 21 is being displaced in either direction through a distance X.

Once displacement of the direction control spool 21, in either direction, exceeds distance X, the position of the direction control spool 21 will be established by the pressure differential generated by control signals A and B and will vary with the magnitude of those control signals, while the logic shuttle 61 remains in fully displaced position, subjected to pressure, equivalent to either control signal A or B, depending on the direction of displacement of the direction control spool 21 from its neutral position. Therefore, the direction of displacement of the direction control spool 21 is the same and therefore fully synchronized with the displacement of the logic shuttle 61 through its entire stroke once the direction control spool 21 is displaced in either direction from its neutral position through distance X. The feature of anticipation and that of displacement of the logic shuttle 61, before the direction control spool 21 is moved from its neutral position, is also achieved. Therefore, irrespective of the magnitude of the pressure differential and irrespective of the direction of the effective force, developed on the direction control spool 21 by the control pressure differential, the direction of displacement of the valve spool 21 from its neutral position will remain always fully synchronized with the direction of displacement of the logic shuttle 61, as long as the actual pressure of A and B control signals is not permitted to drop below that, equivalent to the preloads of the biasing springs 62 and 63.

The direction of displacement of the direction control spool 21 automatically determines the direction of displacement of the load W and direction of displacement of the logic shuttle 61 which, in a manner as described in detail in my U.S. Pat. No. 4,610,194, automatically identifies the load pressure as being positive or negative.

If the load pressure is of a positive type, the positive load pressure from port 64 through line 66 is transmitted to the control chamber 67. Then, in a manner well known to those skilled in the art, the throttling spool 68 will automatically establish a modulating position, throttling by throttling ports 71 tee fluid flow from the inlet chamber 72 to the outlet chamber 73, to maintain a relatively constant pressure differential across an orifice created by displacement of the positive load metering slots 26 or 27.

If the load pressure is of a negative type, the negative load pressure from port 65 is transmitted through line 75 to the control chamber 76. Then, in a manner well known to those skilled in the art, the throttling spool 77 will automatically establish a modulating position throttling by throttling ports 80, the fluid flow from the outlet chamber 81 to the exhaust chamber 82, to maintain a relatively constant pressure differential across an orifice, created by displacement of the negative load metering slots 28 or 29.

If the dead band of the direction control spool 21 is so selected that it is either equal to or larger than distance X, the feature of anticipation of the load pressure identifying circuit is maintained, while in the load controlling position of the direction control spool 21, the logic shuttle 61 remains fully synchronized with the direction of displacement of the direction control spool 21 and fully independent of the variation in the control pressure differential, to which the direction control spool 21 is subjected.

In some types of controlling systems and especially in systems using electro-hydraulic servo valves in control of the direction control spool 21, the direction of the effective force, generated by the control pressure differential, due, for example, to the inertia of the direction control spool 21, may be in a different direction to that of the direction of displacement of the direction control spool 21 from its neutral position. As shown on the drawing the direction of displacement of the logic shuttle 61 becomes independent of the variation in the pressure differential to which the direction control spool 21 is subjected and therefore synchronization between the direction of displacement of the direction control spool 21 and the direction of displacement of the logic shuttle 61 is fully maintained, under all operating conditions as long as the pressure of the A and B control signals is maintained above a certain predetermined minimum level, as established by the preload in the biasing springs 62 and 63.

In the vicinity of neutral position of the valve spool 21 as determined by distance X, which can be selected at small values, the inertial effect of the valve spool 21 and its influence on pressure differential is the same as the required displacement of the logic spool 61. The sudden reversal in pressure differential in practical systems only occur in positions of the valve spool 21 greater than that of distance X. Therefore, in a manner as described above, once the valve spool 21 is displaced from its neutral position, through a distance greater than X, it automatically becomes fully synchronized with the direction of displacement of the logic spool 61.

Although the preferred embodiments of this invention have been shown and described in detail, it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. A load responsive system including a fluid power actuator operable to control a positive or negative load W, a source of pressure fluid, fluid exhaust means, flow control means of said load responsive system, and first valve means for selectively interconnecting said actuator with said source of pressure fluid and said fluid exhaust means, positioning means of said first valve means responsive to first and second control signals, load pressure identifying means operable to identify the type of load pressure as positive or negative and to supply said identified load pressure to said flow control means, logic means responsive to said control signals in said load pressure identifying means, and synchronizing means between said first valve means and said logic means responsive to the direction of displacement of said first valve means from its neutral position to selectively control the connection of the first and second control signals with the logic means.

2. A load responsive system as set forth in claim 1 wherein said load pressure identifying means includes a leakage orifice operable to interconnect said load pressure identifying means for a limited fluid flow with said fluid exhaust means.

3. The load responsive system as set forth in claim 1 wherein said logic means includes a logic shuttle.

4. A load responsive system as set forth in claim 3 wherein said logic shuttle has biasing springs operable to bias said logic shuttle towards a position deactivating said flow control means.

5. A load responsive system as set forth in claim 1 wherein said first valve means has a direction control spool provided with first and second force generating means respectively responsive to said first and said second control signals.

6. A load responsive system as set forth in claim 5 wherein said direction control spool has spring biasing means operable to bias said spool means towards its neutral position.

7. A load responsive system as set forth in claim 1 wherein said synchronizing means includes control signal blocking means operable to selectively block transmittal of said first and said second control signals to said load pressure identifying means in response to the direction of displacement of said first valve means from its neutral position.

8. A load responsive system as set forth in claim 7 wherein said control signal blocking means includes timing means operative to selectively block the first and second control signals after a predetermined displacement of the first valve means from its neutral position.

9. A load responsive system as set forth in claim 7 wherein said control signal blocking means has a signal chamber operably connected to said load pressure identifying means.

10. A load responsive system as set forth in claim 9 wherein said first valve means has cut off edges operable to selectively isolate said first and said second control signals in response to displacement of said first valve means.

* * * * *